US006237225B1

(12) United States Patent
Tarrant

(10) Patent No.: US 6,237,225 B1
(45) Date of Patent: May 29, 2001

(54) SCRAPING TOOL FOR VINYL FLOORS

(76) Inventor: Charles D. Tarrant, 9226 Greenwood Rd. Apt. #417, Greenwood, LA (US) 71033

( * ) Notice: Subject to any disclaimer, the term of this patent is extended or adjusted under 35 U.S.C. 154(b) by 0 days.

(21) Appl. No.: 09/470,758

(22) Filed: Dec. 23, 1999

(51) Int. Cl.[7] ..... B26B 3/00

(52) U.S. Cl. ..... 30/169; 30/337; 15/236.01; D32/49

(58) Field of Search ..... 30/169, 329, 332, 30/337; 15/236.01, 236.05, 236.06; D32/46, 48, 49, 40

(56) References Cited

U.S. PATENT DOCUMENTS

D. 105,214 7/1937 Genung .
D. 235,965 * 7/1975 Grinnell et al. .
D. 303,027 8/1989 Gray .
D. 313,682 1/1991 Marin et al. .
D. 368,345 3/1996 Fisher .
D. 388,573 12/1997 Rostron .
2,535,253 12/1950 Anderson .
2,895,217 * 7/1959 Fisher .
3,061,928 * 11/1962 Waters et al. .
5,887,312 * 3/1999 Curtin .

* cited by examiner

*Primary Examiner*—Hwei-Slu Payer

(57) ABSTRACT

A scraping tool for vinyl floors for easily and conveniently removing vinyl flooring, in particular. The scraping tool for vinyl floors includes an elongate shaft having a head portion and a handle portion with the head portion having a greater breadth than that of the handle portion and having a recessed portion in the top thereof near a bladed front edge, and also includes a bladed member having a bladed front edge and being removeably secured in the recessed portion, and further includes a bracket member having a bladed front edge and being securely fastened to the head portion with the bladed member being securely engaged between the head portion and the bracket member. The elongate shaft has an intermediate angled portion and is approximately 5½ feet long.

5 Claims, 2 Drawing Sheets

SCRAPING TOOL FOR VINYL FLOORS

BACKGROUND OF THE INVENTION

1. Field of the Invention

The present invention relates to a leveraged scraping tool and more particularly pertains to a new scraping tool for vinyl floors for easily and conveniently removing vinyl flooring, in particular.

2. Description of the Prior Art

The use of leveraged scraping tool is known in the prior art. More specifically, leveraged scraping tool heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. Des. 313,682; U.S. Pat. No. Des. 105,214; U.S. Pat. No. 2,535,253; U.S. Pat. No. Des. 388,573; U.S. Pat. No. Des. 303,027; and U.S. Pat. No. Des. 368,345.

While these devices fulfill their respective, particular objectives and requirements, the aforementioned patents do not disclose a new scraping tool for vinyl floors. The inventive device includes an elongate shaft having a head portion and a handle portion with the head portion having a greater breadth than that of the handle portion and having a recessed portion in the top thereof near a bladed front edge, and also includes a bladed member having a bladed front edge and being removeably secured in the recessed portion, and further includes a bracket member having a bladed front edge and being securely fastened to the head portion with the bladed member being securely engaged between the head portion and the bracket member. The elongate shaft has an intermediate angled portion and is approximately 5½ feet long.

In these respects, the scraping tool for vinyl floors according to the present invention substantially departs from the conventional concepts and designs of the prior art, and in so doing provides an apparatus primarily developed for the purpose of easily and conveniently removing vinyl flooring, in particular.

SUMMARY OF THE INVENTION

In view of the foregoing disadvantages inherent in the known types of leveraged scraping tool now present in the prior art, the present invention provides a new scraping tool for vinyl floors construction wherein the same can be utilized for easily and conveniently removing vinyl flooring, in particular.

The general purpose of the present invention, which will be described subsequently in greater detail, is to provide a new scraping tool for vinyl floors which has many of the advantages of the leveraged scraping tool mentioned heretofore and many novel features that result in a new scraping tool for vinyl floors which is not anticipated, rendered obvious, suggested, or even implied by any of the prior art leveraged scraping tool, either alone or in any combination thereof.

To attain this, the present invention generally comprises an elongate shaft having a head portion and a handle portion with the head portion having a greater breadth than that of the handle portion and having a recessed portion in the top thereof near a bladed front edge, and also includes a bladed member having a bladed front edge and being removeably secured in the recessed portion, and further includes a bracket member having a bladed front edge and being securely fastened to the head portion with the bladed member being securely engaged between the head portion and the bracket member. The elongate shaft has an intermediate angled portion and is approximately 5½ feet long.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new scraping tool for vinyl floors which has many of the advantages of the leveraged scraping tool mentioned heretofore and many novel features that result in a new scraping tool for vinyl floors which is not anticipated, rendered obvious, suggested, or even implied by any of the prior art leveraged scraping tool, either alone or in any combination thereof.

It is another object of the present invention to provide a new scraping tool for vinyl floors which may be easily and efficiently manufactured and marketed.

It is a further object of the present invention to provide a new scraping tool for vinyl floors which is of a durable and reliable construction.

An even further object of the present invention is to provide a new scraping tool for vinyl floors which is susceptible of a low cost of manufacture with regard to both materials and labor, and which accordingly is then susceptible of low prices of sale to the consuming public, thereby making such scraping tool for vinyl floors economically available to the buying public.

Still yet another object of the present invention is to provide a new scraping tool for vinyl floors which provides in the apparatuses and methods of the prior art some of the advantages thereof, while simultaneously overcoming some of the disadvantages normally associated therewith.

Still another object of the present invention is to provide a new scraping tool for vinyl floors for easily and conveniently removing vinyl flooring, in particular.

Yet another object of the present invention is to provide a new scraping tool for vinyl floors which includes an elongate shaft having a head portion and a handle portion with the head portion having a greater breadth than that of the handle portion and having a recessed portion in the top thereof near a bladed front edge, and also includes a bladed member having a bladed front edge and being removeably secured in the recessed portion, and further includes a bracket member having a bladed front edge and being securely fastened to the head portion with the bladed member being securely engaged between the head portion and the bracket member. The elongate shaft has an intermediate angled portion and is approximately 5½ feet long.

Still yet another object of the present invention is to provide a new scraping tool for vinyl floors that gives the user greater leverage thus making it easier for the user to remove the vinyl flooring.

Even still another object of the present invention is to provide a new scraping tool for vinyl floors that virtually simplifies the process of removing vinyl flooring.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
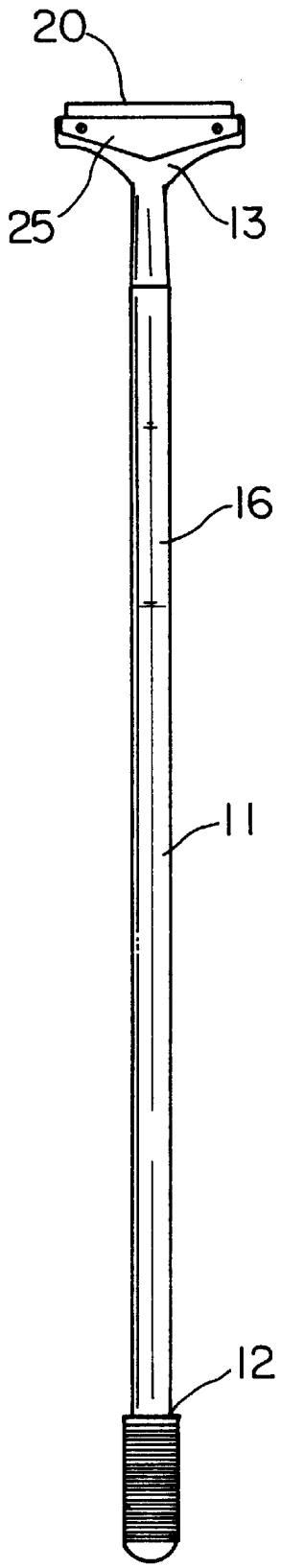
FIG. 1 is a top elevational view of a new scraping tool for vinyl floors according to the present invention.
Figure 2:
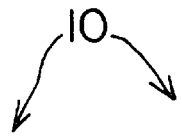
FIG. 2 is a side elevational view of the present invention.
Figure 2:
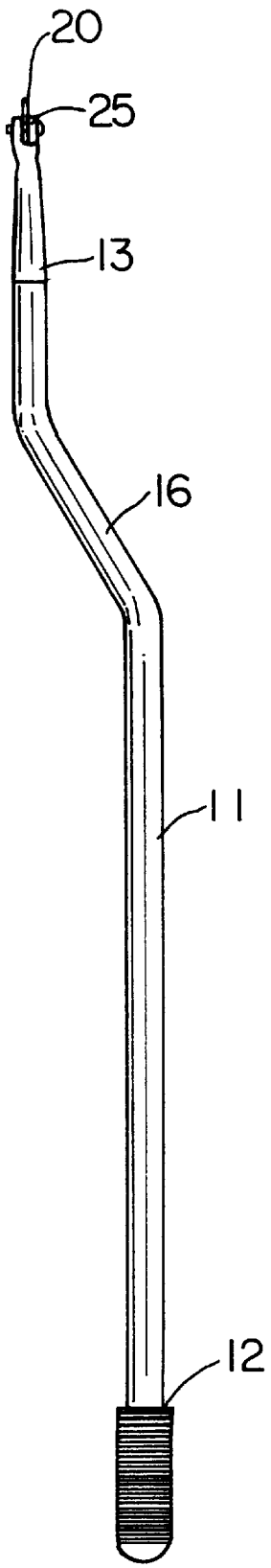
Figure 3:
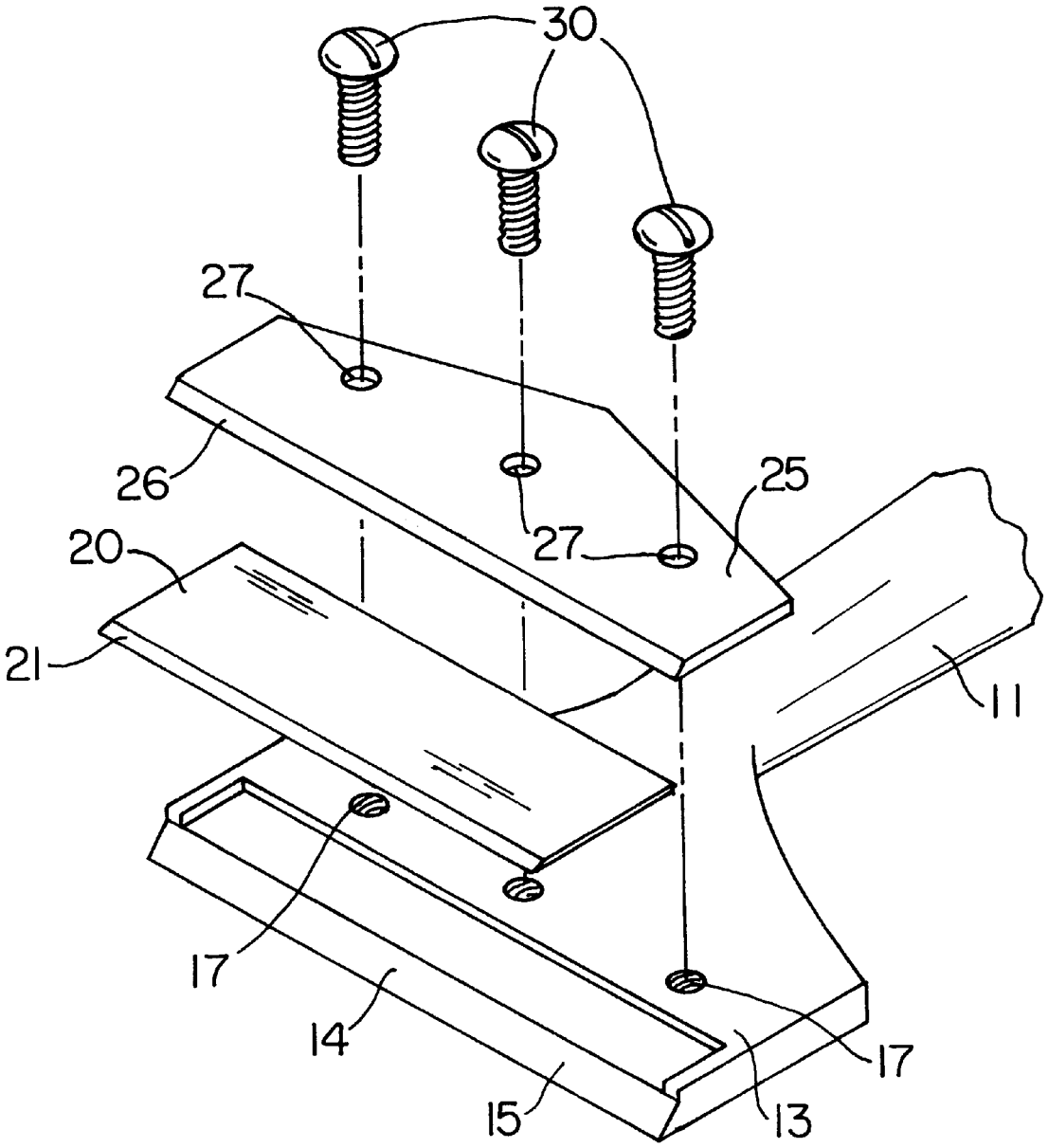
FIG. 3 is an exploded perspective view of the present invention.

With reference now to the drawings, and in particular to FIGS. 1 through 3 thereof, a new scraping tool for vinyl floors embodying the principles and concepts of the present invention and generally designated by the reference numeral 10 will be described.

As best illustrated in FIGS. 1 through 3, the scraping tool 10 for vinyl floors generally comprises an elongate shaft 11 having a handle portion 12 and a head portion 13 which has a front edge 15 and a recessed portion 14 in a top thereof at the front edge 15 and has a greater breadth than that of the handle portion 12 and has a plurality of holes 17 therethrough. The elongate shaft 11 has an angled portion 16 relative to the handle portion 12 and to the head portion 13. The angled portion 16 is intermediate of the handle portion 12 and the head portion 13 but closer to the head portion 13. The handle portion 12 is parallel to the head portion 13 with the front edge 15 of the head portion 13 being essentially a bladed edge. The elongate shaft 11 is approximately 5½ feet long, and approximately 1 inch in diameter except for the head portion 13. A bladed member 20 having a front bladed edge 21 is removeably but securely received in the recessed portion 14 and is essentially a plate-like member. A bracket member 25 having a front edge 26 and a plurality of holes 27 therethrough is fastenable to the head portion 13 to secure the bladed member 20 in the recessed portion 14. The bracket member 25 is a thin, plate-like member having a front edge 26 which is essentially a bladed edge, the bracket member 25 being fastenably secured to the head portion 13 with fastening members 30 such as bolts with the bladed member 20 being securely and removeably engaged between the bracket member 25 and the head portion 13.

In use, the user takes the scraping tool 10 and uses the bladed edges to scrape along a vinyl floor to remove the vinyl flooring. The length of the elongate shaft 11 and the angled portion 16 allows the user to easily and quickly remove the vinyl flooring.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A scraping tool for vinyl floors comprising:

an elongate shaft having a handle portion and a head portion which has a front edge and a recessed portion in a top thereof at said front edge and has a greater breadth than that of said handle portion, said elongate shaft having an angled portion relative to said handle portion and to said head portion, said angled portion being intermediate of said handle portion and said head portion near said head portion, said handle portion being parallel to said head portion, said front edge of said head portion being essentially a bladed edge, said elongate shaft being approximately 5½ feet long and approximately 1 inch in diameter except for the head portion, a bladed member having a front bladed edge and being received in said recessed portion and including a plate member; and a bracket member having a front edge and being fastenable to said head portion to secure said bladed member in said recessed portion, said bracket member including a thin, plate member having a front edge which is essentially a bladed edge, said bracket member being fastenably secured to said head portion with fastening members with said bladed member being securely and removeably engaged between said bracket member and said head portion.

2. A scraping tool for vinyl floors comprising:

an elongate shaft having a handle portion and a head portion which has a front edge and a recessed portion at said front edge and has a greater breadth than that of said handle portion;

a bladed member having a front bladed edge and being received in said recessed portion; and a bracket member having a front edge and being fastenable to said head portion to secure said bladed member in said recessed portion;

said elongate shaft having an angled portion relative to said handle portion and to said head portion, said angled portion being intermediate of said handle portion and said head portion near said head portion, said handle portion being parallel to said head portion.

3. A scraping tool for vinyl floors as described in claim 2, wherein said front edge of said head portion is essentially a bladed edge.

4. A scraping tool for vinyl floors as described in claim 2, wherein said bladed member includes a plate member.

5. A scraping tool for vinyl floors as described in claim 2, wherein said bracket member includes a thin, plate member having a front edge which is essentially a bladed edge, said bracket member being fastenably secured to said head portion with fastening members with said bladed member being securely and removeably engaged between said bracket member and said head portion.

* * * * *